US007780251B2

(12) United States Patent
Dubach et al.

(10) Patent No.: US 7,780,251 B2
(45) Date of Patent: Aug. 24, 2010

(54) RETRACTING DEVICE FOR A DRAWER

(75) Inventors: Fredi Dubach, Bäretwil (CH); Klaus Brüstle, Höchst (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 12/314,840

(22) Filed: Dec. 17, 2008

(65) Prior Publication Data

US 2009/0127990 A1 May 21, 2009

Related U.S. Application Data

(63) Continuation of application No. PCT/AT2007/000271, filed on Jun. 5, 2007.

(30) Foreign Application Priority Data

Jun. 22, 2006 (AT) ..... A 1052/2006

(51) Int. Cl.
*A47B 88/14* (2006.01)

(52) U.S. Cl. ..... 312/319.7; 312/319.1; 312/319.5

(58) Field of Classification Search ... 312/319.5–319.8, 312/319.1, 330.1
See application file for complete search history.

(56) References Cited

U.S. PATENT DOCUMENTS 905,544 A * 12/1908 Lambert et al. ..... 312/319.1
2,187,012 A * 1/1940 Brenner ..... 477/13
3,028,209 A * 4/1962 Hinkel et al. ..... 312/319.7
3,298,765 A * 1/1967 Rakich ..... 312/319.7
3,378,321 A * 4/1968 Sobel et al. ..... 312/215
3,854,785 A * 12/1974 Manner et al. ..... 312/319.1
4,828,344 A * 5/1989 Omata ..... 312/319.1
4,852,932 A * 8/1989 Komeya et al. ..... 296/37.9
5,087,107 A * 2/1992 Fumanelli ..... 312/333
5,143,432 A 9/1992 Ohshima et al.
5,820,234 A * 10/1998 Capwell et al. ..... 312/216
6,371,584 B1 * 4/2002 Alreck ..... 312/235.1
2004/0100169 A1 5/2004 Huber et al.
2006/0214547 A1 * 9/2006 Bonner et al. ..... 312/319.5
2007/0044723 A1 * 3/2007 Anderbery ..... 119/51.02
2008/0115417 A1 * 5/2008 Huber ..... 49/349
2008/0116775 A1 * 5/2008 Huber ..... 312/319.5

(Continued)

FOREIGN PATENT DOCUMENTS

DE 26 31 488 2/1977

(Continued)

OTHER PUBLICATIONS

International Search Report issued Nov. 29, 2007 in the International (PCT) Application No. PCT/AT2007/000271 of which the present application is a continuation.

(Continued)

*Primary Examiner*—Janet M Wilkens
(74) *Attorney, Agent, or Firm*—Wenderoth, Lind & Ponack, L.L.P.

(57) ABSTRACT

A retracting device for a drawer, including a pulling device which can be connected to the drawer, a drive unit having an electric motor, and a roller drivable by the drive unit for winding up the pulling device, wherein the drive unit is activatable by a rotation of the roller.

14 Claims, 8 Drawing Sheets

U.S. PATENT DOCUMENTS

| | | | | |
|---|---|---|---|---|
| 2008/0191591 | A1 * | 8/2008 | Blucher et al. | 312/319.1 |
| 2009/0102338 | A1 * | 4/2009 | Wenzel et al. | 312/319.1 |

FOREIGN PATENT DOCUMENTS

| | | | |
|---|---|---|---|
| DE | 20 2004 000 714 | | 12/2004 |
| EP | 0 465 800 | | 1/1992 |
| EP | 0 847 937 | | 6/1998 |
| EP | 1 374 732 | | 1/2004 |
| GB | 2239864 | * | 7/1991 |
| GB | 2 245 157 | | 1/1992 |
| WO | 2004/023933 | | 3/2004 |

OTHER PUBLICATIONS

Austrian Patent Office Search Report issued Feb. 7, 2007 in Austrian Patent Application No. A1052/2006 to which the present application claims priority.

* cited by examiner

RETRACTING DEVICE FOR A DRAWER

This is a Continuation Application of International Application No. PCT/AT2007/000271 filed Jun. 5, 2007.

The present invention concerns a retracting device for a drawer, comprising a pulling device which can be connected to the drawer, a drive unit having an electric motor, and a roller drivable by the drive unit for winding up the pulling device.

A retracting device of that kind is found, for example, in EP 465 800 A1, wherein the uppermost section of a setting rod serving as a pulling device is releasably connected to a drawer in the form of a washing agent tray. The setting rod and therewith the drawer can be both extended and also retracted by an electric motor. Triggering of the drive unit is effected by way of a button to be operated by the user.

The object of the invention is to develop a retracting device of the general kind set forth above in such a way that the operating convenience thereof is increased.

The fact that the drive unit (in concrete terms: the electric motor of the drive unit) is activatable by a rotation of the roller device makes it possible to dispense with triggering a switch arranged on the carcass or body of the item of furniture or on the drawer. Instead, the drive unit can be operated in the opening direction by the exertion of a small manual force by the user on the drawer. The movement of the drawer, caused thereby, is transmitted to the roller by way of the pulling device and the drive unit is activatable by the resulting rotary movement of the roller.

In an embodiment in which the pulling device can transmit both pulling and also pushing forces to the drawer, it is appropriate for the design configuration thereof to include a pulling device having a certain stiffness (for example in the form of a steel strip).

It will be noted, however, that alternatively it can also be provided that the pulling device is adapted only to apply pulling forces to the drawer. In that case the pulling device may be a cable, for example.

In the second-mentioned case the retracting device may naturally only apply forces to the drawer in the closing direction. In that case a separate device, for example a touch-latch mechanism, can be provided for ejecting the drawer from the closed position.

If the pulling device does not involve any stiffness (for example it involves a cable), it is necessary to provide a configuration in which that the pulling device is constantly under a certain stress because otherwise the drawer being pushed in by the user in the direction toward the closed position would not necessarily cause a rotation of the roller. By way of example, without additional measures, the cable could easily be in a condition of hanging down. In that case, the drive unit would not be activated for further retracting the drawer.

In this connection it can be provided that the roller is acted upon by a spring (preferably a coil spring) in one of the two possible directions of rotation. It is preferably provided in that respect that the spring is adapted and arranged relative to the roller in such a way that it is loaded by a rotation of the roller, which is linked to the pulling device being unwound. In that case the arrangement provides that the pulling device, which is in fact connected to the drawer and the roller, is constantly under stress in the opened condition of the drawer. If now the drawer is moved by the user out of the open position slightly into the closed position, that movement is transmitted by way of the stressed pulling device to the roller and the drive unit is activated to assist with the further movement.

If the retracting device serves only to move the drawer in the direction of the closed position, it should be provided that the drive unit is so adapted and/or is so coupled to the roller that the roller is manually substantially freely rotatable in one of the two possible directions of rotation. This ensures that no resistance to the movement of the drawer from the closed position into the open position (manually or by a separate device) is opposed by the drive unit. It will be noted that in that case it may be necessary to apply the force required for loading up the spring that is optionally provided. As the spring does not serve for retraction of the drawer but only for providing a certain stressing for the pulling device, it does not have to be particularly strong, and thus there is no need to overcome high forces when loading the spring.

It can further be provided that the roller is drivable by the drive unit only in one of the two possible directions of rotation.

Depending on the nature of the uncoupling device, an entrainment portion can be provided at an end of the pulling device, by way of which the drawer can be coupled again to the pulling device after being inserted into the carcass of the item of furniture and moved into the closed position.

If it is provided that the pulling device can be wound up by the spring when the drawer is in the uncoupled condition, by virtue of actuation by the roller, it can also be provided that the drive unit of the retracting device can be triggered by the actuation of a switch which is independent of the roller, instead of by a rotation of the roller.

It can further be provided that that switch device is in the form of a two-part coupling, wherein the one part is non-rotatably connected to the housing of the drive unit and the second part also rotates upon a rotation of the shaft of the drive unit.

Protection is also claimed for an arrangement which includes a retracting device in accordance with one of the aforementioned embodiments, a drawer mounted movably in a body or carcass of an item of furniture between an open position and a closed position, and a coupling device for coupling and uncoupling the pulling device of the retracting device to or from the drawer.

In such an arrangement it can preferably be provided that the retracting device is so adapted that the pulling device can be wound up by the spring when the drawer is in the uncoupled condition, by actuation of the roller. It will be appreciated that in that case the spring is to be so strong that it can cause rotation of the roller for winding up the pulling device. Winding up the pulling device ensures that no tangling of the pulling device occurs when the drawer is uncoupled and possibly removed from the carcass of the item of furniture.

Furthermore, protection is sought for an arrangement having a drawer which is mounted movably between an open position and a closed position in a carcass of an item of furniture, having a retracting device for a drawer with a pulling device which can be connected to the drawer, a drive unit having an electric motor and a roller drivable by the drive unit for winding up the pulling device, wherein the arrangement includes an ejection device for moving the drawer out of the closed position.

Protection is further sought for an arrangement as just referred to above, in which the drive unit is activatable by a rotation of the roller.

A further embodiment of that arrangement provides that the drive unit of the retracting device is triggerable by the actuation of a switch which is independent of the roller.

In addition there can be provided an arrangement in which the ejection device is structurally separate from the retracting device, but is mounted jointly therewith to a mounting element.

Further advantages and details of the invention will be apparent from the specific description hereinafter and the drawings in which.

Figure 4A:
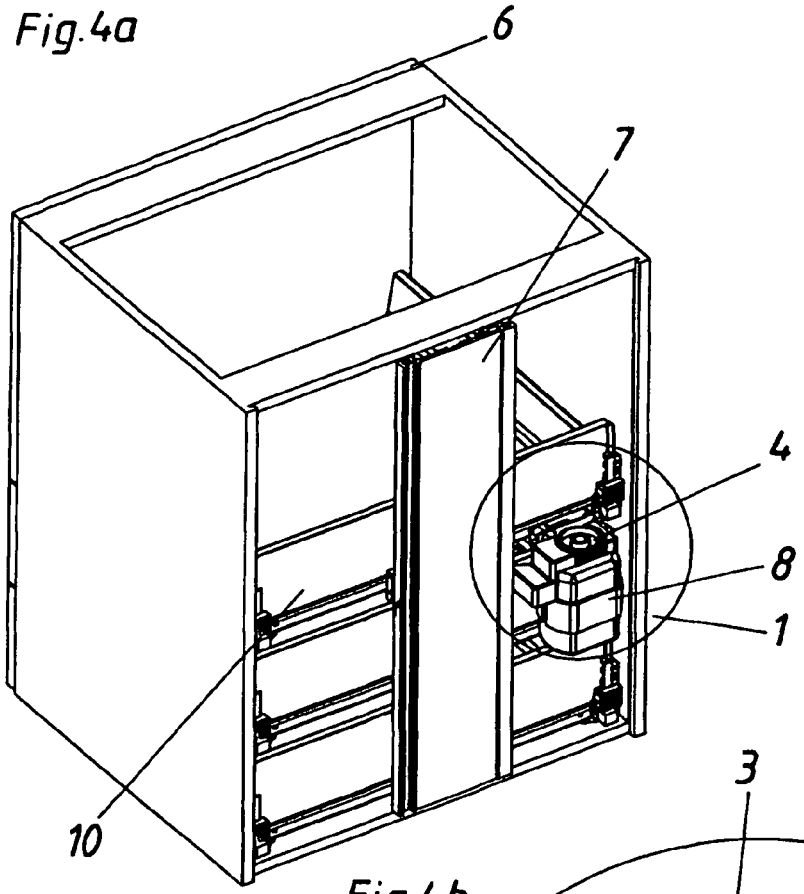
Figure 4B:
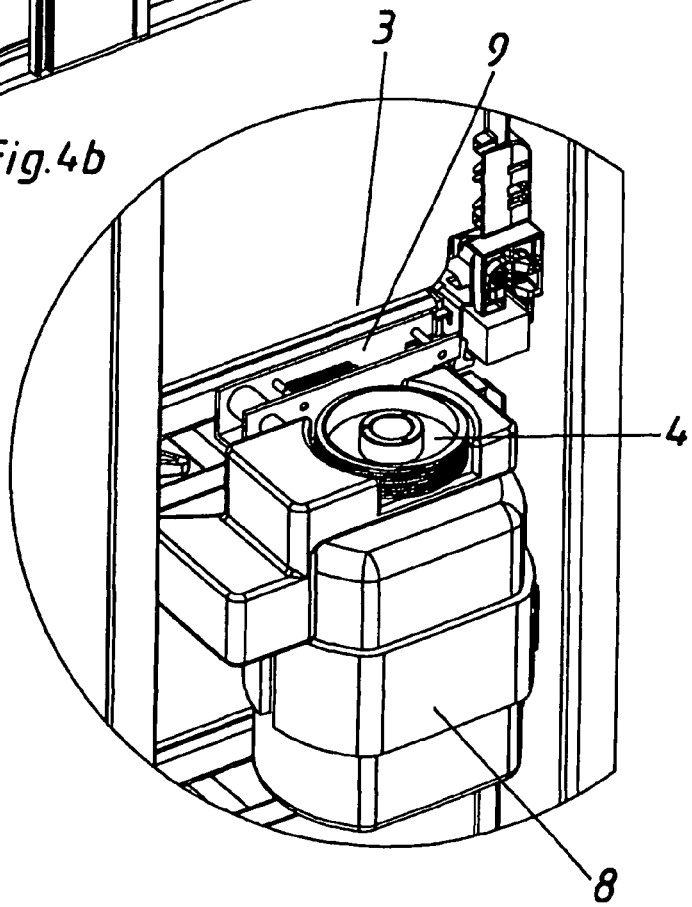
Figure 5B:
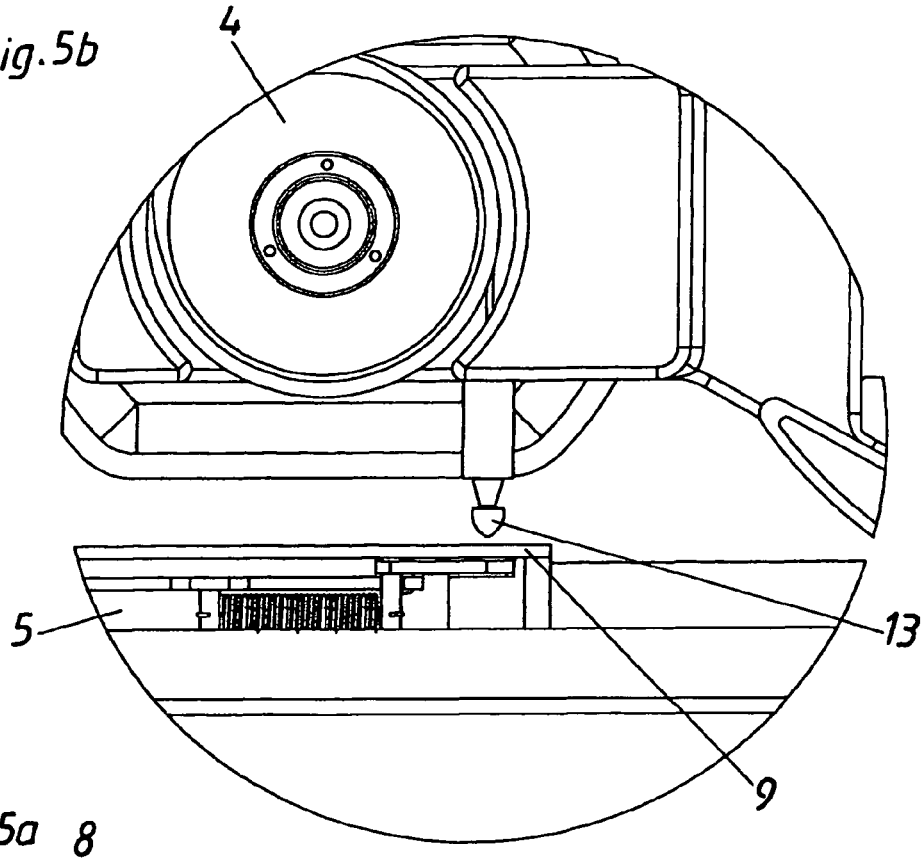
Figure 5A:
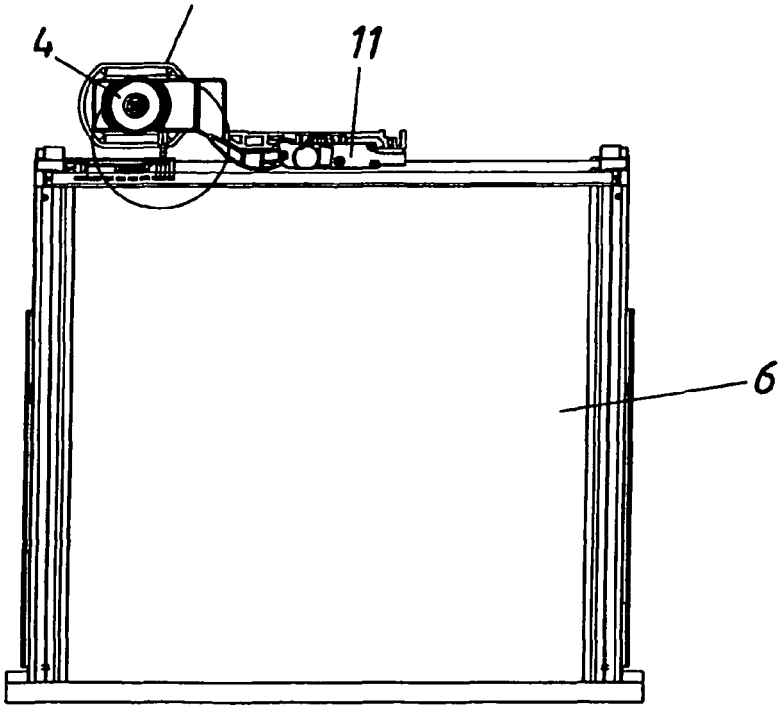
Figure 6A:
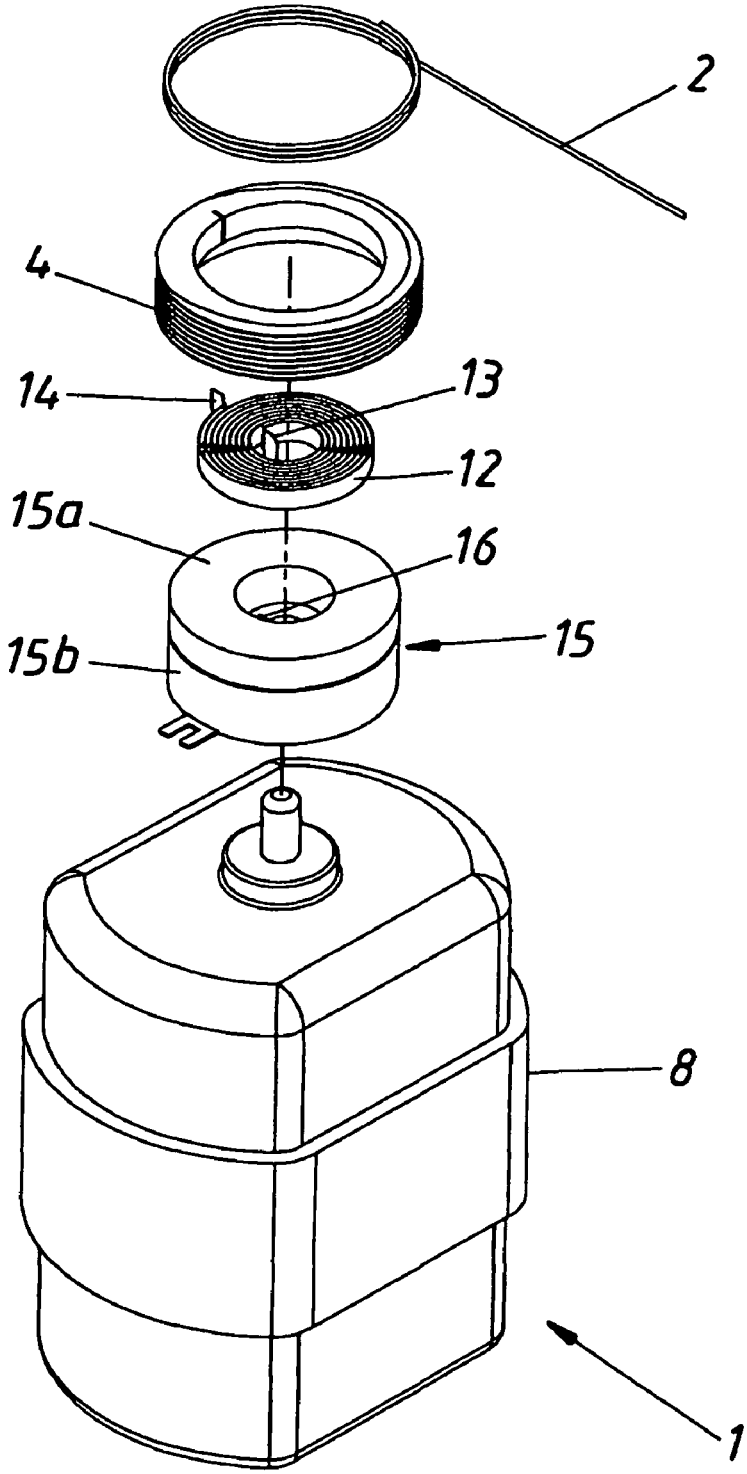
Figure 6B:
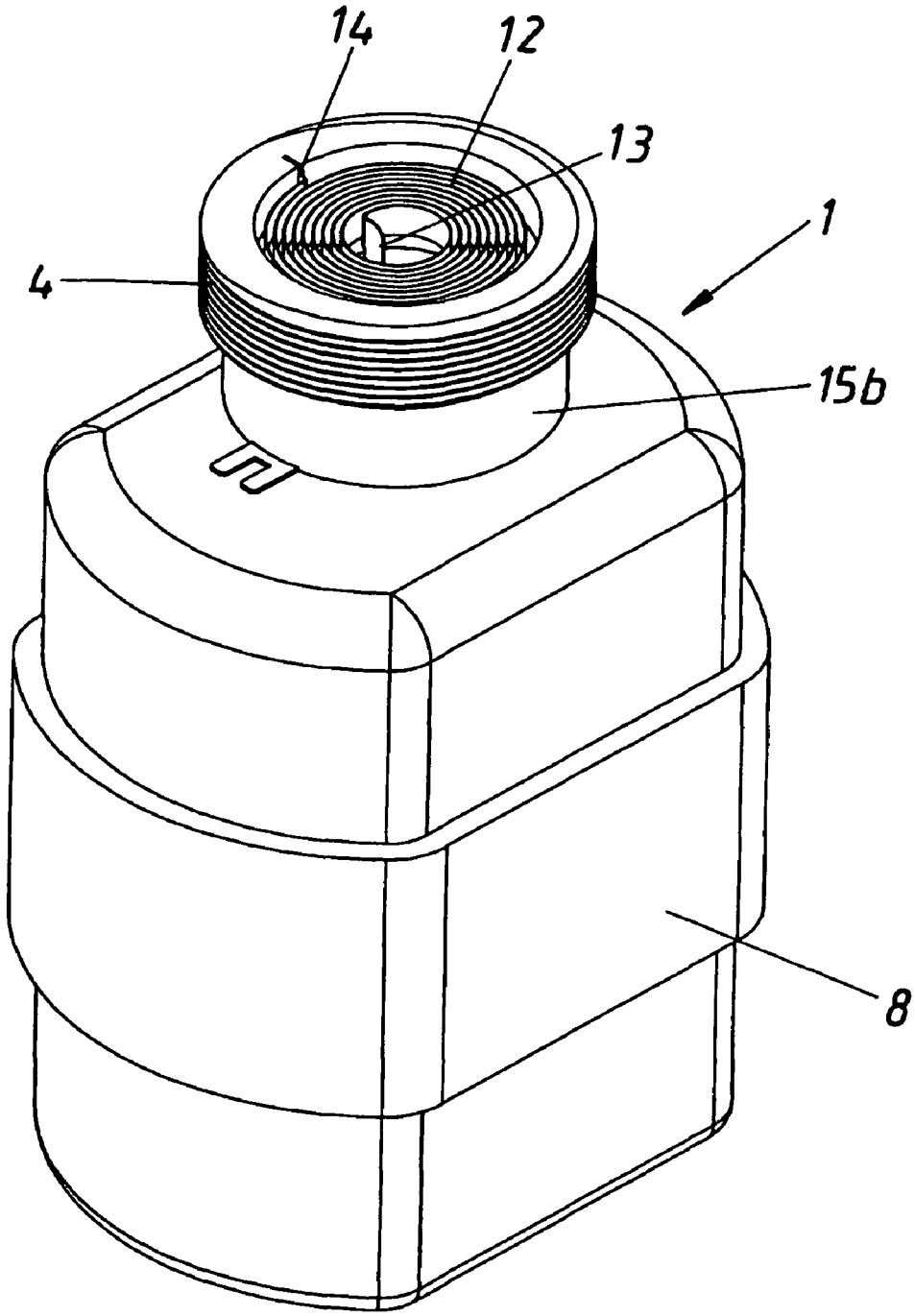
Figure 7:
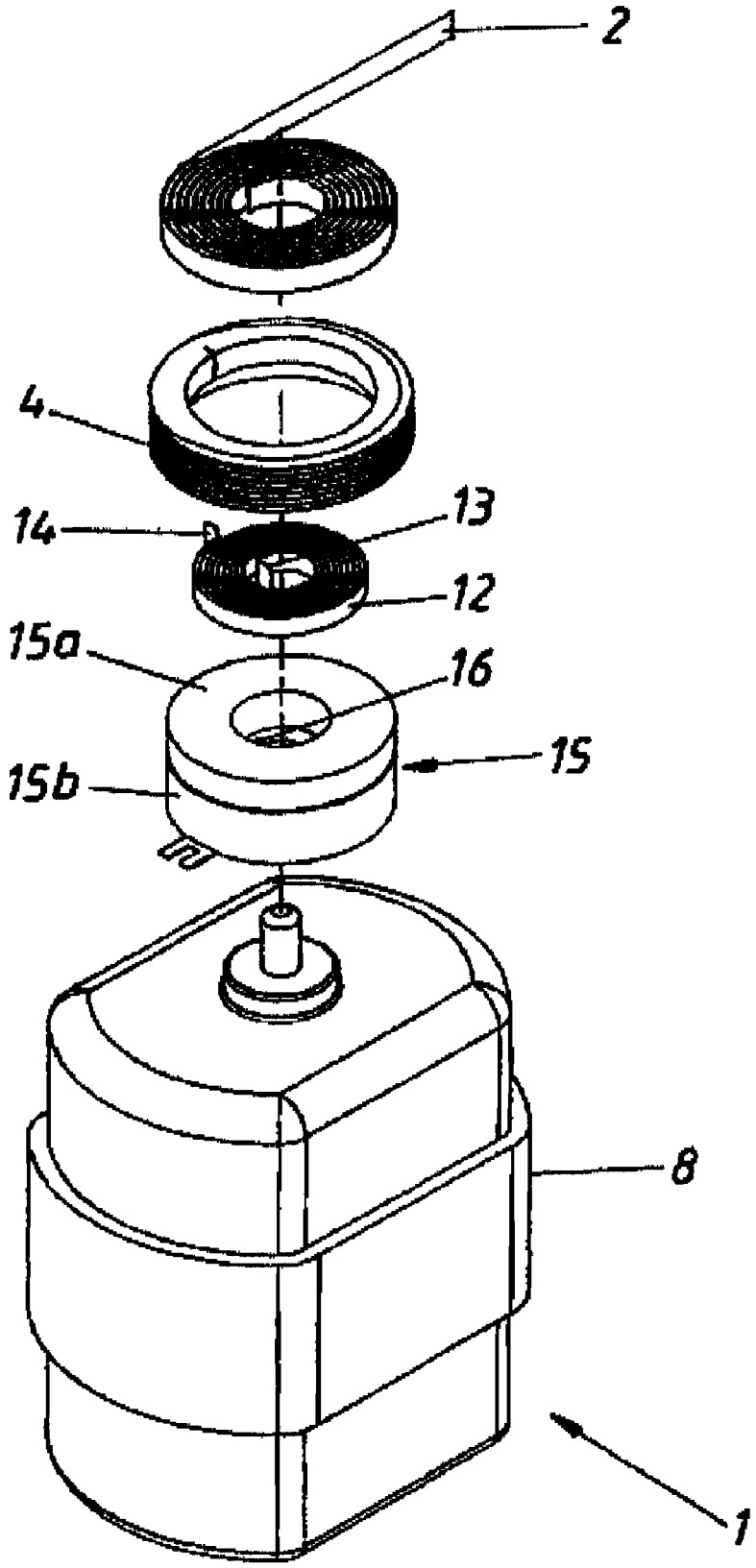

FIGS. 4*a* and 4*b* show a rear view of an arrangement according to the invention with a detail view, FIGS. 5*a* and 5*b* show further detail views of the arrangement according to the invention, FIGS. 6*a* and 6*b* show a partly exploded view and perspective view respectively of an embodiment of a retracting device according to the invention, and FIG. 7 shows a partly exploded view of another embodiment of the retracting device.

Figure 1:
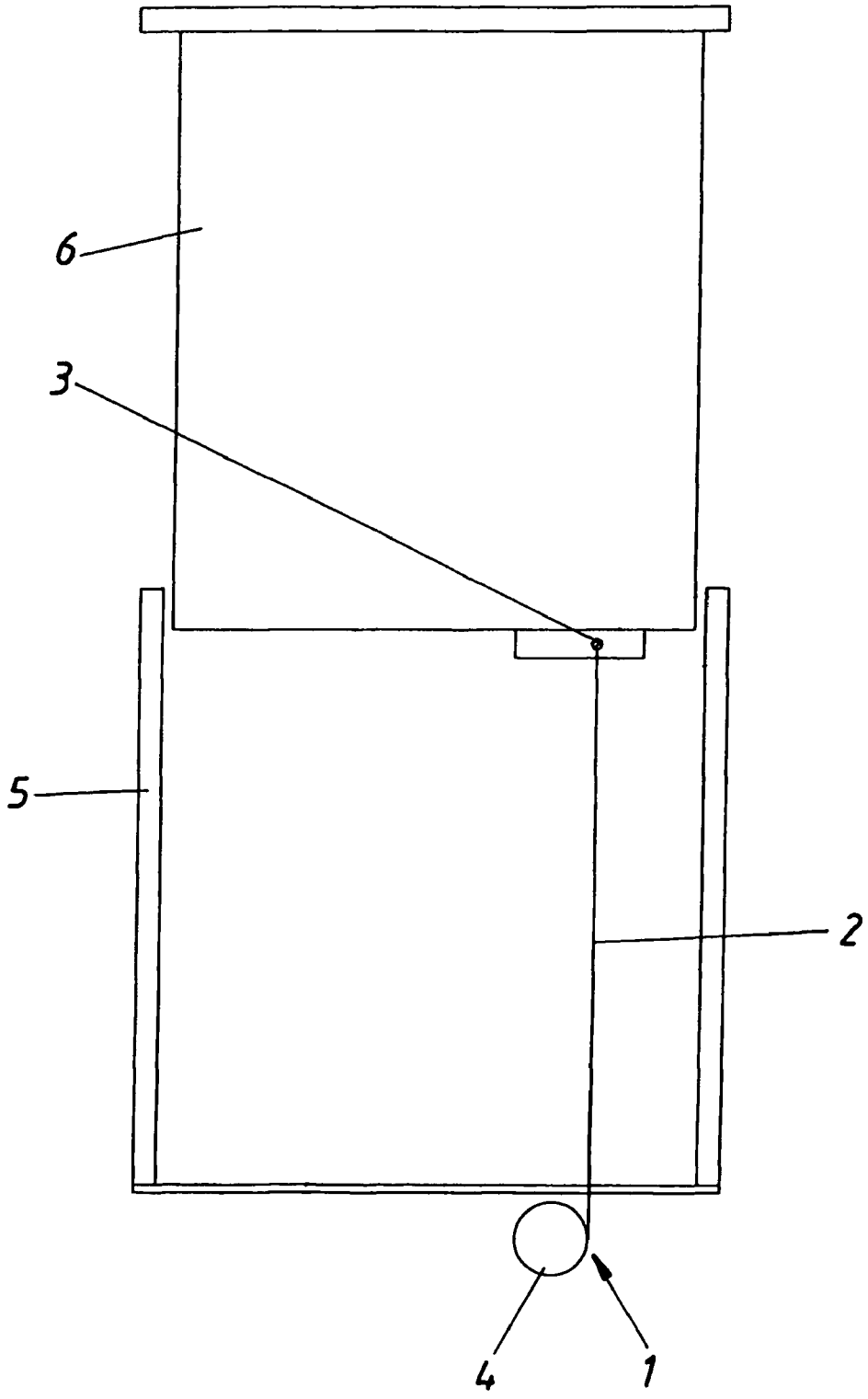
FIG. 1 shows a schematic view of an arrangement according to the invention.

FIG. 1 schematically shows an item of furniture comprising a carcass 5 and a drawer 6 mounted therein and being movable between an open position and a closed position. In this respect the drawer 6 is in the open position in the condition shown in FIG. 1. The drawer 6 is coupled to the roller 4 of the retracting device 1 by way of a pulling device 2. In this case coupling is effected by way of a coupling device 3 which is of a releasable nature.

Figure 2:
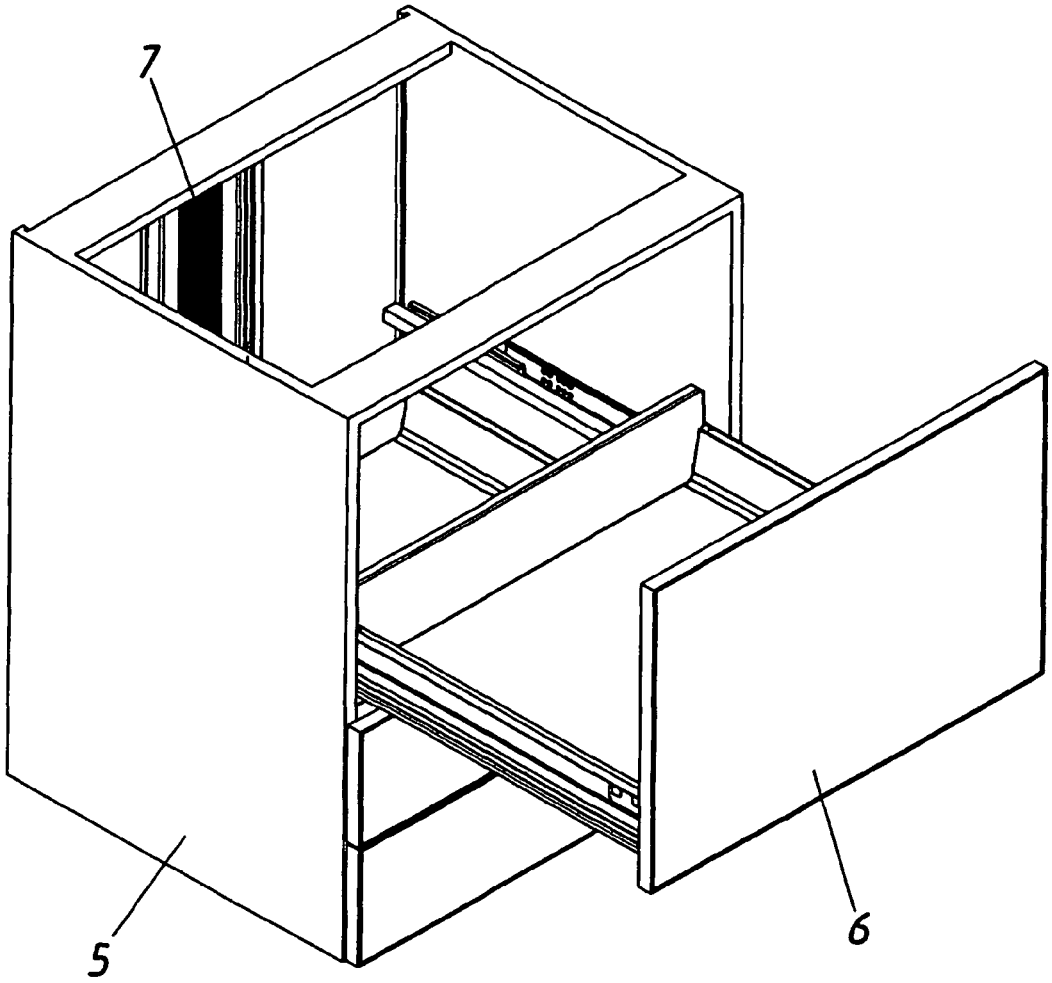
FIG. 2 shows a perspective view in relation to FIG. 1.

FIG. 2 shows a perspective view of the item of furniture, wherein a carrier rail 7 for an ejection device 11 shown in FIG. 5*a* is visible at the rear wall of the carcass 5.

Figure 3:
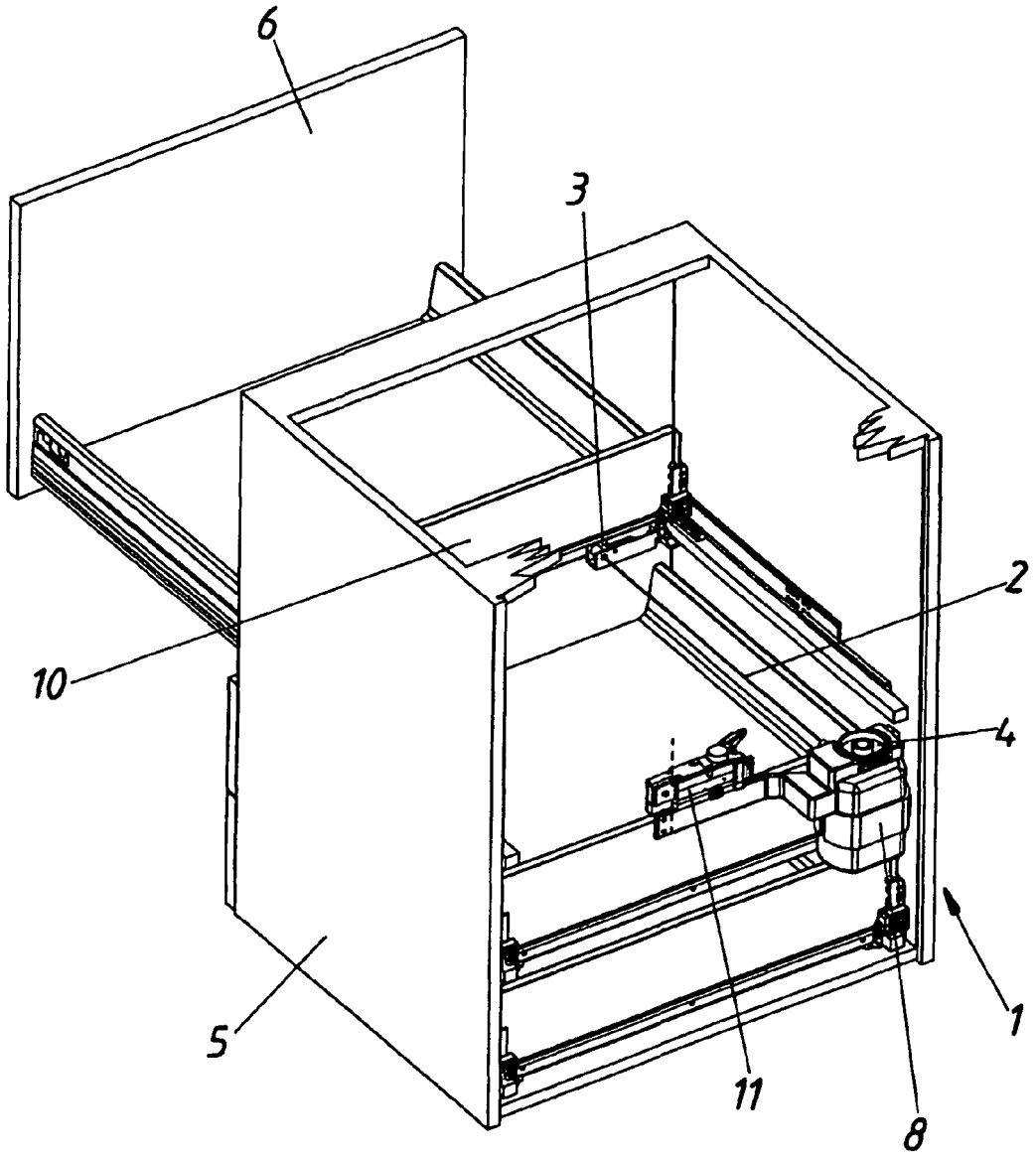
FIG. 3 shows a further perspective view in relation to FIG. 1.

FIG. 3 shows a rear view in relation to FIG. 2 with the rear wall partially broken away. It is possible to see in particular the drive unit 8 of the retracting device 1 and the roller 4 of the retracting device 1, on which the pulling device 2 which in this case is in the form of a cable is partially rolled up. The pulling device 2 is coupled to the rear wall 10 of the drawer 6 by way of a coupling device 3. The ejection device 11 can also be seen in FIG. 3.

FIG. 4*a* shows a rear view of the item of furniture shown in FIG. 3, with the drawer 6 here being in the closed position. FIG. 4*b* shows a detail view of the retracting device, while in addition it is possible to see a part 9 of the coupling device 3.

The function of the coupling device 3 is described in greater detail hereinafter with reference to FIGS. 5*a* and 5*b*.

FIG. 5*a* shows the drawer 6 in its closed position in the carcass 5 (not shown). In this case the pulling device 2 is uncoupled from the drawer 6 (see FIG. 5*b*). By virtue of a movement of the drawer 6 into the carcass of the item of furniture, the entrainment portion 13 which is mounted to the pulling device 2 passes into the part 9 of the coupling device 3 and is latched in position there. In that condition the drawer 6 is coupled to the pulling device 2 and thus to the retracting device 1. In the present embodiment a movement of the drawer 6 out of the closed position is effected either purely manually or with the support of the ejection device 11. In contrast, a movement of the drawer 6 in the direction of the closed position is effected by way of the retracting device 1, more specifically by way of the roller 4 being driven by the drive unit 8, by the pulling device 2 being wound up, which is linked thereto, and by the drawer 6 being retracted by way of the entrainment portions 13 and the part 9 of the coupling device. In this embodiment the drive device 8 of the retracting device 1 is triggered by a slight movement of the drawer 6 in the direction toward the closed position.

In the following embodiment the pulling device 2 is a cable, and there is provided a coil spring 12 which acts on the roller 4 in the closing direction and thus holds the pulling device 2 under stress when the drawer 6 is coupled (see FIGS. 6*a* and 6*b*).

The structure of an embodiment of a retracting device 1 according to the invention can be seen from FIGS. 6*a* and 6*b*. In this case, the roller 4 is arranged non-rotatably on the shaft of a drive unit 8, and the pulling device 2 is partially wound on the roller 4. The roller 4 is acted upon by the coil spring 12. The end 14 of the coil spring 12 is fixed to the roller 4 and the end 13 of the coil spring 12 is fixed to the coupling 15. The coupling 15 (forms in this embodiment the switch device 15) is of a two-part nature, wherein the first part 15*a* also rotates upon a rotation of the shaft of the drive unit 8. The second part 15*b* is connected non-rotatably to the housing of the drive unit 18 and has an anchoring device 16 for the end 13 of the coil spring 12.

In this embodiment, the coupling 15 serves to permit free manual rotatability in the opening direction while upon a movement in the retraction direction the drive unit 8 is rotationally coupled to the roller 4.

Activation of the drive unit 8 is effected by the switch device 15 by way of a rotation of the roller 4 (more specifically in the embodiment of FIG. 6*a* in the counter-clockwise direction).

FIG. 6*b* shows the retracting device 1 in the assembled condition.

The invention claimed is:

1. A retracting device for a drawer, comprising:

a pulling device which can be connected to the drawer;

a drive unit having an electric motor, a shaft which is driven by the electric motor, and a housing; and a roller drivable by the drive unit for winding up the pulling device, wherein the drive unit is activatable by a switch device, the switch device being a two-part coupling including a first part and a second part, wherein the first part of the two-part coupling rotates upon a rotation of the shaft of the drive unit and the second part of the two-part coupling is non-rotatably connected to the housing of the drive unit, and wherein the switch device is connected to the roller such that the drive unit is activatable by a rotation of the roller.

2. A retracting device as set forth in claim 1, wherein the drive unit is adapted and/or coupled to the roller such that the roller is manually substantially freely rotatable in one of two possible directions of rotation.

3. A retracting device as set forth in claim 1, wherein the drive unit is adapted and/or coupled to the roller such that the roller is drivable only in one of two possible directions of rotation.

4. A retracting device as set forth in claim 1, wherein the roller is acted upon by a spring in one of two possible directions of rotation.

5. A retracting device as set forth in claim 4, wherein the spring is adapted and arranged relative to the roller such that the spring is loaded up by a rotation of the roller, such rotation being linked to unwinding of the pulling device.

6. A retracting device as set forth in claim 4, wherein the pulling device is a cable.

7. A retracting device as set forth in claim 4, wherein the pulling device is adapted to transmit pulling forces and pushing forces to the drawer.

8. A retracting device as set forth in claim 7, wherein the pulling device is a steel strip for transmitting pulling forces and pushing forces to the drawer.

9. A retracting device as set forth in claim 4, wherein the spring is a coil spring.

10. An arrangement including:

a retracting device as set forth in claim 1, a drawer mounted in a carcass of an item of furniture, the drawer being movable between an open position and a closed position, and a coupling device for coupling and uncoupling the pulling device of the retracting device to and from the drawer.

11. An arrangement as set forth in claim 10, wherein the retracting device includes a spring which acts on the roller, and wherein the retracting device is adapted such that the pulling device can be wound on to the roller by the spring actuating the roller when the drawer is uncoupled.

12. An arrangement comprising:

a drawer mounted in a carcass of an item of furniture, the drawer being movable between an open position and a closed position;

an ejection device for moving the drawer out of the closed position; and a retracting device for the drawer, comprising a pulling device which can be connected to the drawer, a drive unit having an electric motor and a shaft which is driven by the electric motor, and a roller drivable by the drive unit for winding up the pulling device, wherein the drive unit is activatable by a switch device, the switch device being a two-part coupling including a first part and a second part, wherein the first part of the two-part coupling rotates upon a rotation of the shaft of the drive unit and the second part of the two-part coupling is non-rotatably connected to the housing of the drive unit, and wherein the switch device is connected to the roller such that the drive unit is activatable by a rotation of the roller.

13. An arrangement as set forth in claim 12, wherein the drive unit of the retracting device is triggerable by the actuation of a switch which is independent of the roller.

14. An arrangement as set forth in claim 12, wherein the ejection device is structurally separate from the retracting device.

* * * * *